US010074295B2

(12) United States Patent
Hyman

(10) Patent No.: US 10,074,295 B2
(45) Date of Patent: Sep. 11, 2018

(54) PHOTOLUMINESCENT IDENTIFIER SYSTEM FOR FIREFIGHTING EQUIPMENT

(71) Applicant: F. D. Signworks, LLC, Loxahatchee, FL (US)

(72) Inventor: Matthew J. Hyman, Loxahatchee, FL (US)

(73) Assignee: F. D. Signworks, LLC, Loxahatchee, FL (US)

( * ) Notice: Subject to any disclaimer, the term of this patent is extended or adjusted under 35 U.S.C. 154(b) by 0 days.

(21) Appl. No.: 15/494,078

(22) Filed: Apr. 21, 2017

(65) Prior Publication Data

US 2017/0309206 A1 Oct. 26, 2017

Related U.S. Application Data

(60) Provisional application No. 62/325,824, filed on Apr. 21, 2016.

(51) Int. Cl.

| | |
|---|---|
| ***G09F 3/10*** | (2006.01) |
| ***G09F 13/20*** | (2006.01) |
| *G09F 3/02* | (2006.01) |

(52) U.S. Cl.

CPC ..... *G09F 13/20* (2013.01); *G09F 3/10* (2013.01); *G09F 2003/023* (2013.01); *G09F 2003/0257* (2013.01); *G09F 2003/0272* (2013.01)

(58) Field of Classification Search

CPC . G09F 13/20; G09F 3/10; G09F 15/02; G09F 2013/0459

USPC ..... 40/542

See application file for complete search history.

(56) References Cited

U.S. PATENT DOCUMENTS

| | | | | |
|---|---|---|---|---|
| 2,387,512 A * | 10/1945 | Hilberg | C09D 5/22 | 116/DIG. 14 |
| 3,452,464 A * | 7/1969 | Robinson | G09F 13/16 | 40/542 |
| 4,401,050 A * | 8/1983 | Britt | A62B 3/00 | 116/205 |
| 4,945,458 A | 7/1990 | Batts et al. | | |
| 5,111,366 A | 5/1992 | Rife et al. | | |
| 5,151,678 A | 9/1992 | Veltri et al. | | |
| 5,415,911 A * | 5/1995 | Zampa | B32B 37/12 | 359/529 |
| 5,564,128 A | 10/1996 | Richardson | | |
| 5,698,301 A * | 12/1997 | Yonetani | B32B 7/02 | 428/213 |
| 5,811,174 A * | 9/1998 | Murakami | C09K 11/02 | 250/484.4 |
| 6,237,266 B1 * | 5/2001 | Tassey | G08B 7/066 | 362/153 |

(Continued)

*Primary Examiner* — Shin H Kim

(74) *Attorney, Agent, or Firm* — McHale & Slavin, P.A.

(57) ABSTRACT

The present system provides a lightweight fire-resistant photoluminescent identifier system for firefighters, which is suitable for use on the firefighter's facemask, as well as other equipment. The system is lightweight and provides individual recognition of an individual firefighter. The identifier system lights up automatically in a low-light environment without batteries, yet prevents glare to the firefighter using the system. The components that comprise the system are fire-resistant to temperatures up to and exceeding 500 degrees Fahrenheit to facilitate personal recognition of the individual in dark and low-light areas.

17 Claims, 10 Drawing Sheets

(56) References Cited

U.S. PATENT DOCUMENTS 6,305,028 B1 * 10/2001 Lin ..... A42B 3/061 2/200.1
6,458,464 B1 * 10/2002 Takeda ..... B32B 15/08 428/457
6,785,992 B2 * 9/2004 Chiarucci ..... G08B 7/062 40/596
7,166,369 B2 * 1/2007 Sturley ..... B32B 27/18 250/462.1
7,178,931 B1 2/2007 Murphy
7,832,131 B2 * 11/2010 Thollin ..... G09F 13/20 40/542
2002/0030139 A1 * 3/2002 Apel ..... B64D 11/003 244/118.5
2002/0127361 A1 * 9/2002 Sandt ..... B32B 7/12 428/40.1
2004/0182508 A1 * 9/2004 Apel ..... B64D 11/003 156/249
2004/0202812 A1 * 10/2004 Congard ..... B42D 5/027 428/40.1
2005/0102871 A1 * 5/2005 Merle ..... G09F 13/20 40/542
2005/0142371 A1 * 6/2005 Swain ..... B32B 25/08 428/516
2005/0244595 A1 * 11/2005 Hagen ..... B65D 81/34 428/34.1
2006/0080873 A1 * 4/2006 Riopel ..... G02B 6/005 40/546
2007/0251849 A1 * 11/2007 Lo ..... A61J 1/00 206/459.5
2010/0018092 A1 * 1/2010 Peckham ..... G09F 13/20 40/542
2011/0119972 A1 * 5/2011 Kay ..... G09F 13/20 40/541
2012/0023793 A1 * 2/2012 Williams ..... G09F 13/06 40/542
2012/0076963 A1 3/2012 Jones
2012/0233895 A1 * 9/2012 Martin ..... C09K 11/02 40/542
2014/0008441 A1 * 1/2014 Huynh ..... G09F 3/0294 235/468
2015/0178613 A1 * 6/2015 Hoelzl ..... B32B 37/12 235/488
2017/0309206 A1 * 10/2017 Hyman ..... G09F 13/20
2017/0360256 A1 * 12/2017 Sheridan ..... A47J 37/0786

* cited by examiner

PHOTOLUMINESCENT IDENTIFIER SYSTEM FOR FIREFIGHTING EQUIPMENT

RELATED APPLICATIONS

In accordance with 37 C.F.R 1.76, a claim of priority is included in an Application Data Sheet filed concurrently herewith. Accordingly, the present invention claims priority of U.S. Provisional Patent Application No. 62/325,824, entitled "PHOTOLUMINESCENT IDENTIFIER SYSTEM FOR FIREFIGHTING EQUIPMENT", filed on Apr. 21, 2016. The contents of the above referenced application are herein incorporated by reference in its entirety.

FIELD OF THE INVENTION

This invention relates generally to the field of safety for emergency fire personnel and, in particular, to a fire-resistant photoluminescent identifier system for a self-contained breathing apparatus (SCBA) utilized in firefighting equipment, which illuminates in low-light and/or low visibility areas to provide emergency markers for other emergency personnel.

BACKGROUND OF THE INVENTION

A self-contained breathing apparatus, or SCBA, is a device worn by firefighters and rescue personnel to provide breathable air in an immediate danger to life and health situation. A SCBA typically has three main components: a high-pressure tank, a pressure regulator, and an inhalation connection (face mask), all affixed together and mounted onto a carrying frame. SCBA's are one of the most important items of personal protective equipment used by firefighters and rescue personnel. SCBA's allow firefighters to enter hazardous environments to perform essential interior operations including offensive fire attacks, victim search, rescue and removal, ventilation, and overhaul. They are also used at non-fire incidents involving hazardous materials and confined spaces where there is a threat of toxic fumes or an oxygen-deficient atmosphere.

SCBA systems used in firefighting place an emphasis on quality of materials required for heat and flame resistance above that of manufacturing cost. SCBA systems tend to be expensive because of the exotic materials used to provide heat and flame resistance and, to a lesser extent, to reduce the weight penalty on the firefighter. A major use of SCBA systems is for Search and Rescue (SAR) operations.

One of the most common causes of death of firefighters is the inability to find their way out of a burning building. Firefighters usually perform their work in smoke that is so thick that visibility is extremely limited. When entering a building, firefighters will typically choose a left-hand search pattern or right-hand search pattern, feeling their way along the walls. If a firefighter gets separated from his partner and becomes lost or disoriented, he/she may not be able to find a way out of the burning building.

Larger fires may have an appointed Rapid Intervention Team (RIT) or Rapid Intervention Crew (RIC). The RIT or RIC typically consists of two or three firefighters whose mission is to rescue downed firefighters, for example, firefighters who are injured or who are trapped or lost inside the fire. Time is of the essence for the RIT team. The team must locate the incapacitated or trapped firefighter before he runs out of air. Thus, a lightweight device or system that does not require electrical power, yet is fire resistant and provides a light to help locate the firefighter in a dark or smoky environment, is needed in the art.

Photoluminescent materials, also known as "glow-in-the-dark" materials, incorporate inorganic phosphors into a carrier or substrate. The substrate might be a solvent-based or water-based paint, a magnetic- or adhesive-backed tape, a plastic extrusion, an acrylic or polyurethane casting or injection molded item, or a vinyl film. These photoluminescent (PL) phosphors absorb light in the visible and ultraviolet wavelengths and release visible light in what is often termed an "afterglow". One of the advantages to photoluminescent technology is there is no power source needed to properly function, as such it is self-sustaining. However, a shortcoming to photoluminescent technology is that, when used on the firefighter's facemask, the rearward glow through the lens reduces the firefighter's vision by creating reflections and shadows.

Safety lights mounted on various parts of an emergency personnel's body or equipment is known in the prior art. For instance, U.S. Pat. No. 4,945,458 provides fireman helmets with front and rear lights. The helmets include both a front light assembly and a rear light assembly; however, these devices require a power source attached thereto and do not provide individual recognition of the firefighter. U.S. Pat. No. 5,111,366 discloses a head covering having illuminated indicia formed thereon; however, this device requires an illuminated front panel which is edge-lit by a plurality of lamps or light emitting diodes powered from a battery source. It is not removably securable to any equipment, requires a power source, and is not fire-resistant. U.S. Pat. No. 5,151,678 discloses electroluminescent safety belts which provide for battery operation located within a portion of the belt. U.S. Pat. No. 5,564,128 describes a safety helmet which, when worn by a user, allows for locating and visual identification of the wearer in a hostile environment. Specifically, a safety helmet which provides for an electroluminescent strip member conformed and attached to a face shield or crown with actuating circuitry to provide blinking of the strip member when no motion is detected and emits different colors. The flexible electroluminescent strip member is fixedly secured to the safety helmet for emitting electromagnetic radiation within a visible bandwidth of the electromagnetic energy spectrum. A shortcoming of all of these devices is the requirement of batteries for operation. Batteries often fail at the most undesirable time. In addition, many batteries are an explosion hazard within the high heat environment of a firefighter. Still yet, batteries create an electrical field which may be undesirable around explosive materials. Even further, electroluminescent strips are not fire resistant and may cause damage to the lens of a facemask at temperatures above 200 degrees Fahrenheit, which is far too low of a temperature for most situations.

With the increased world-wide threat of terrorism, along with the already dangerous occupations in fire, military, law enforcement and industry, the need for more devices to help in visual communication and navigation through dangerous emergency situations with little or no visibility are of great importance to both preserving and saving lives. Personal recognition of an individual who has been injured or stranded in a fire would allow other emergency personnel to better assess the situation and provide the best treatment plan to the specific individual. Personal recognition would also be useful, not only if the emergency personnel was injured, but also for situational awareness. Because most emergency crews are required to wear helmets and facemasks, it is difficult to ascertain facial features of other emergency personnel. As such, there is a need for better methods and systems for improving the situational awareness of persons involved in an emergency situation during darkened, smoky, dusty or low-light conditions.

SUMMARY OF THE INVENTION

Thus, the present system provides a lightweight fire-resistant photoluminescent identifier system for firefighter's that is suitable for use on the firefighter's facemask as well as other equipment. The system is lightweight and provides individual recognition of an individual firefighter. The identifier system lights up automatically in a low-light environment without batteries, yet prevents glare to the firefighter using the system. The components that comprise the system are fire-resistant to temperatures up to and exceeding 500 degrees Fahrenheit. The system is constructed from a photoluminescent strip. The photoluminescent identifier system is constructed from various layers that provide properties not typically found in photoluminescent devices. The base layer includes a black or dark back face to prevent light from being directed into the facemask, and a pressure sensitive and heat resistant adhesive. The front surface of the base layer is constructed to be reflective silver. A photoluminescent layer is secured to the front face of the base layer with a heat sensitive adhesive, whereby heat is utilized to bond the photoluminescent layer to the base layer. A top layer is secured over the photoluminescent layer, also with a heat sensitive adhesive. The top layer is cut through in a desired pattern to create indicia when adhered over the photoluminescent layer. In this manner, the firefighter's name or other identifier is visible in both the light and in the dark, while the other desirable properties of the system are also provided.

Accordingly, it is an objective of the present invention to provide a fire-resistant photoluminescent identifier system for firefighters and other emergency personnel which, when worn by a user, allows for visual identification and personal recognition of the wearer in a hostile environment.

It is another objective of the present invention to provide a photoluminescent identifier system that is light in weight and constructed for attachment to emergency personnel equipment such as, but not limited to, a facemask, a helmet or a tank.

Yet another objective of the present invention is to provide a photoluminescent identifier system that lights up automatically in a dark or smoky environment without the need for batteries or other power supplies.

Still yet another objective of the present invention is to provide a photoluminescent identifier system that can be used on the clear facemask of an SCBA without the light being directed into the facemask.

It is still yet another objective of the present invention to provide a photoluminescent identifier system attachable to an SCBA of safety personnel that can withstand temperatures up to 500 degrees Fahrenheit.

A further objective of the present invention is to provide a photoluminescent identifier system that provides for personalized identifying indicia thereon to facilitate personal recognition of the wearer to the other emergency personnel in dark or low-light areas.

Still a further objective of the present invention is to provide a photoluminescent identifier system that is constructed in layers to provide versatility in construction and final configuration.

Still yet a further objective of the present invention is to provide a photoluminescent identifier system that is simple, reliable, requires no maintenance, and has a low cost.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
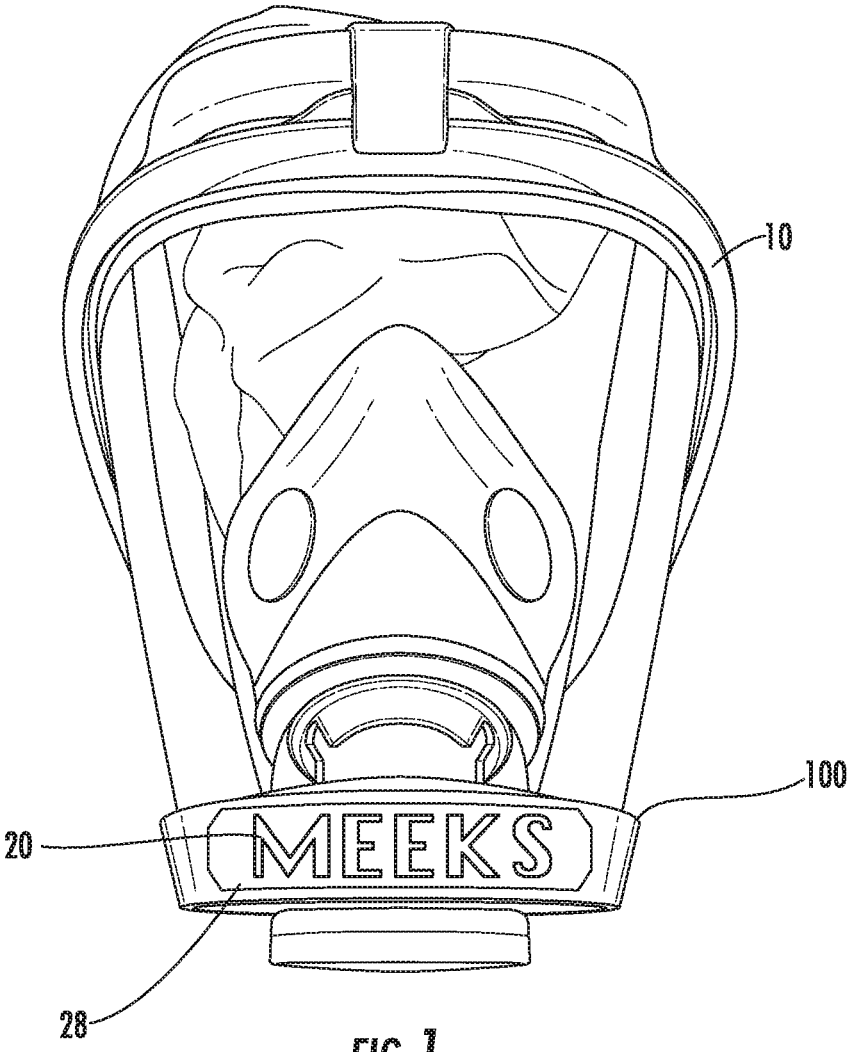
FIG. 1 is a front view of one embodiment of the photoluminescent identifier system secured to the frame of a facemask.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 2:
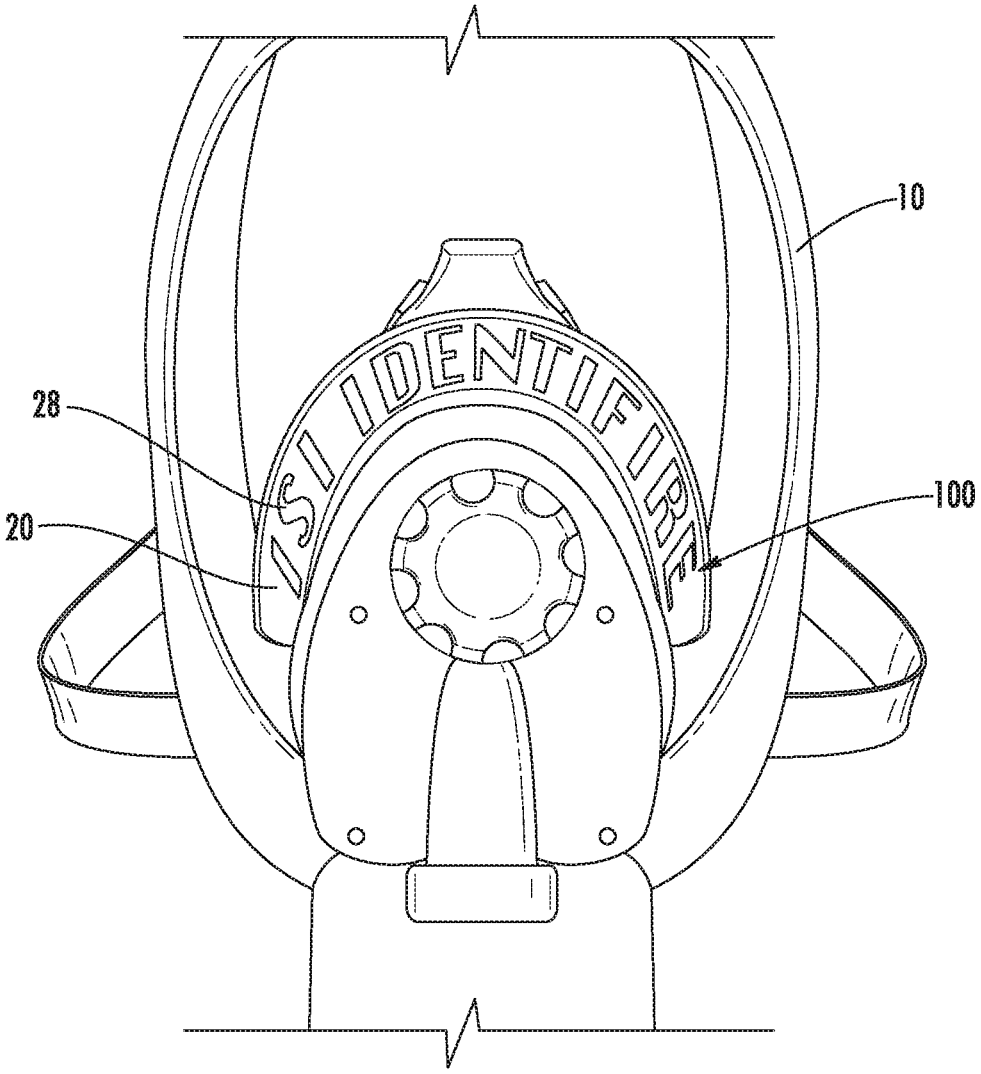
FIG. 2 is a front view of one embodiment of the photoluminescent identifier system secured to the clear portion, or lens, of a facemask, illustrated in low light.
Figure 3:
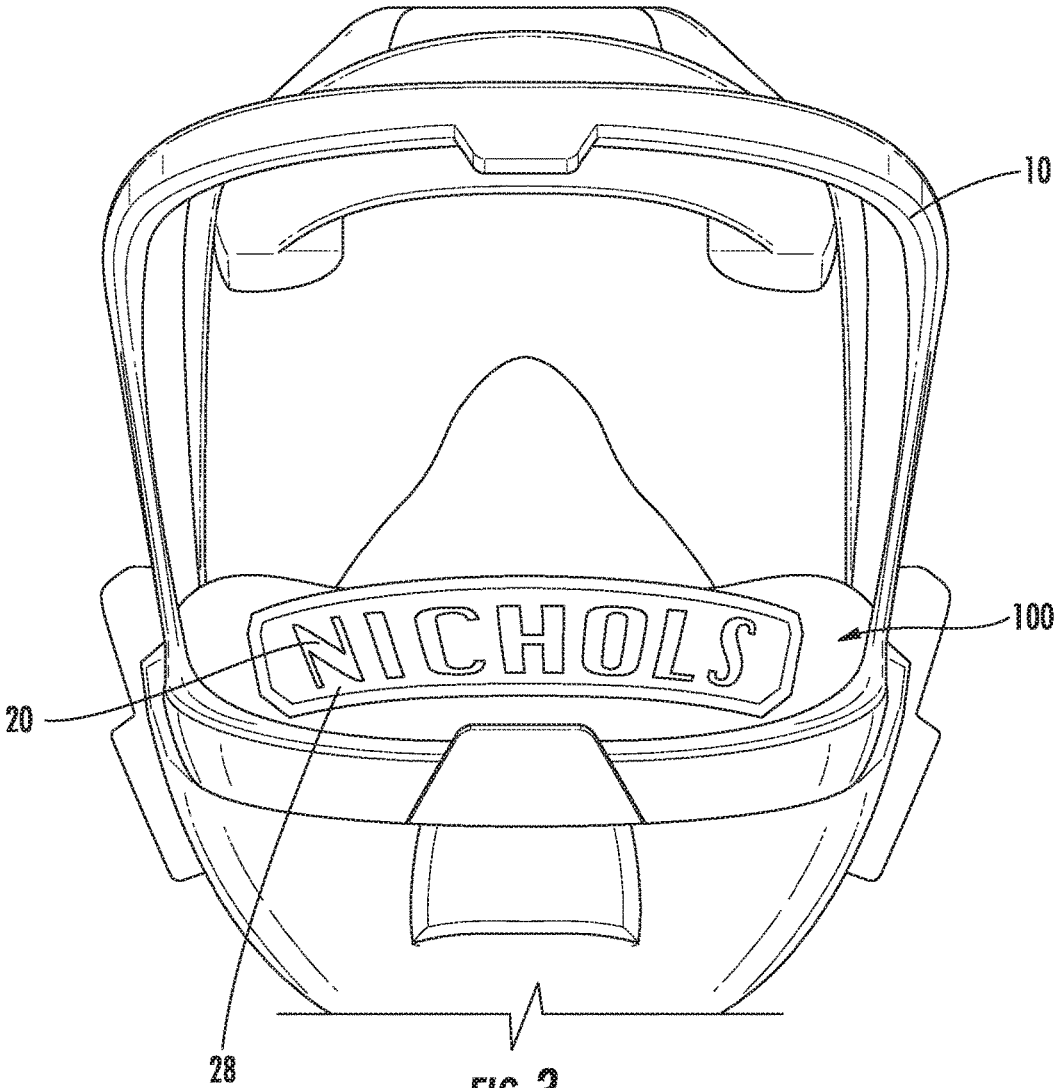
FIG. 3 is a front view of one embodiment of the photoluminescent identifier system secured to the clear portion, or lens, of a facemask, illustrated in full light.
Figure 4:
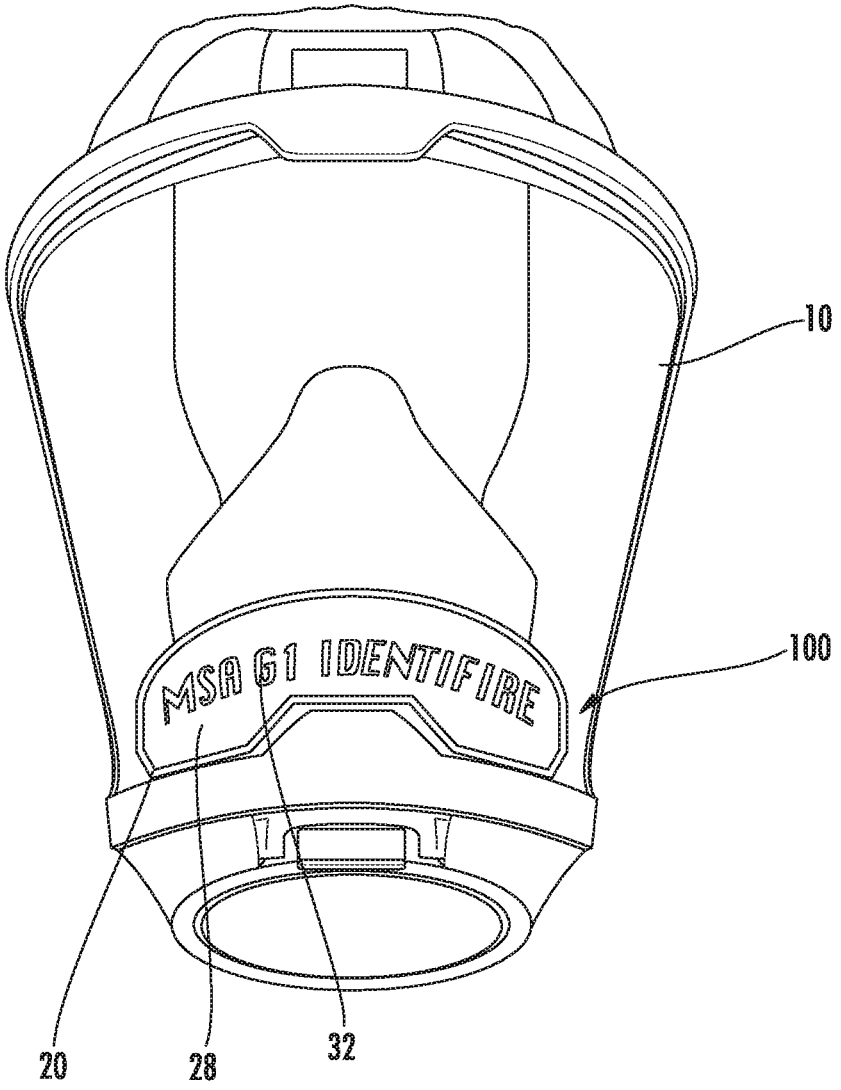
FIG. 4 is a front view of one embodiment of the photoluminescent identifier system secured to the clear portion, or lens, of a facemask, illustrated in full light.
Figure 5:
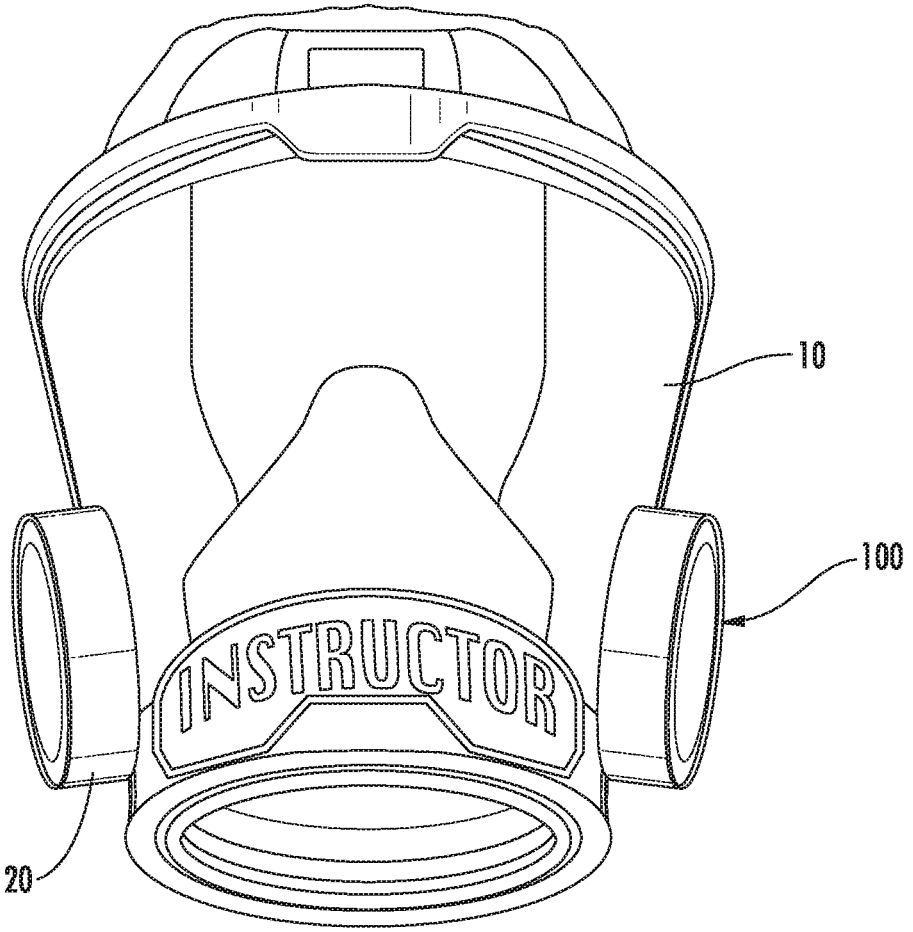
FIG. 5 is a front view of one embodiment of the photoluminescent identifier system secured to the clear portion, or lens, of a facemask, illustrated in full light.
Figure 6:
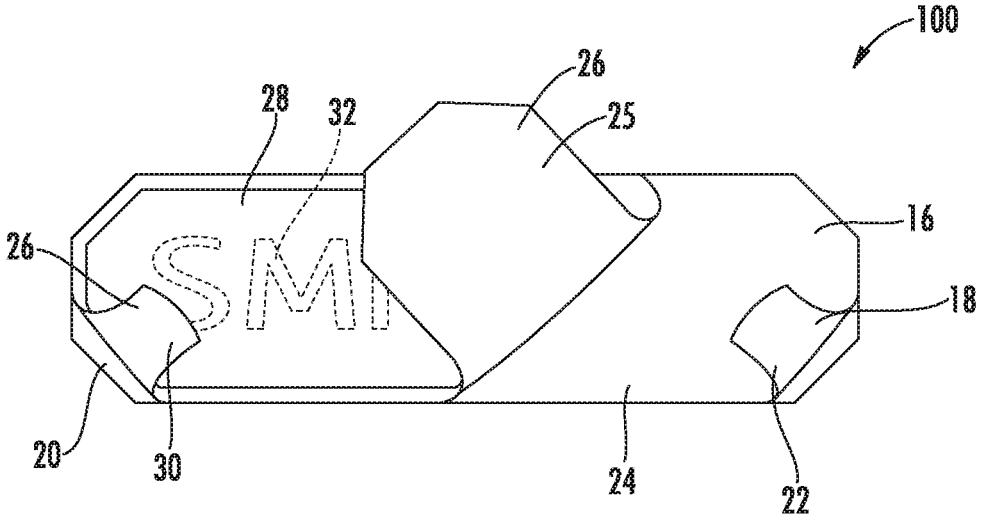
FIG. 6 is a front view illustrating the layered construction of the photoluminescent identifier system.
Figure 7:
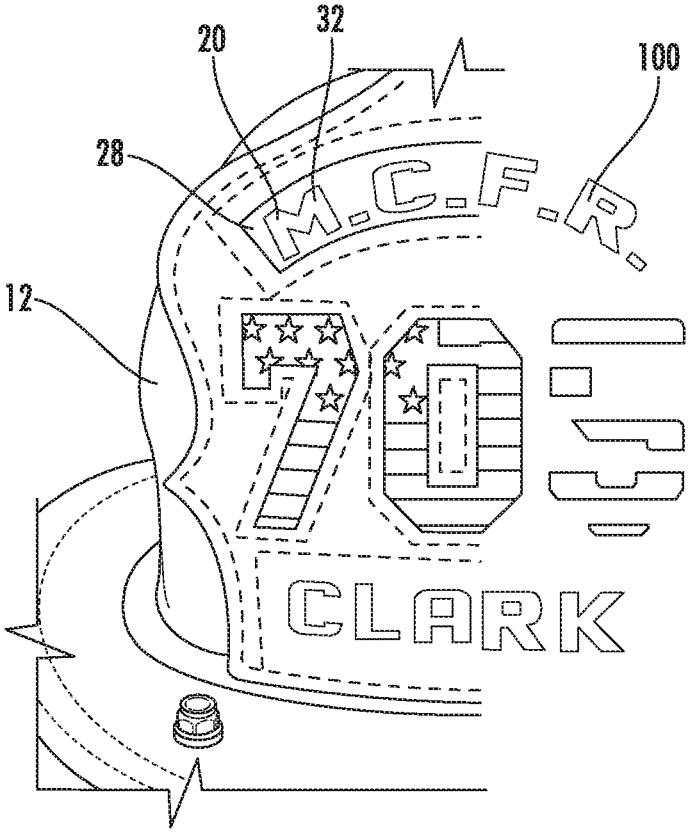
FIG. 7 is a front view illustrating the photoluminescent identifier system secured to a firefighter's helmet, shown half in full light and half in low light.
Figure 8:
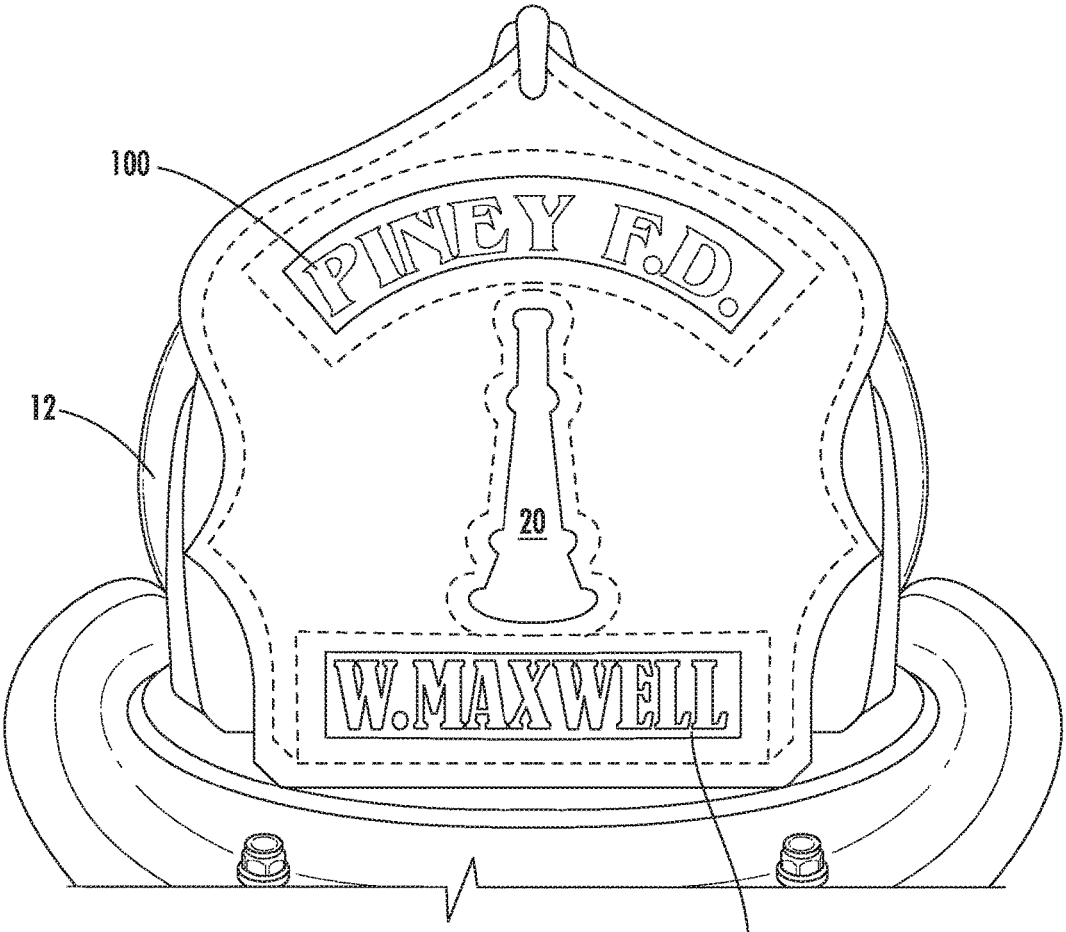
FIG. 8 is a front view illustrating the photoluminescent identifier system secured to a firefighter's helmet, shown secured under leather with cutouts.
Figure 9:
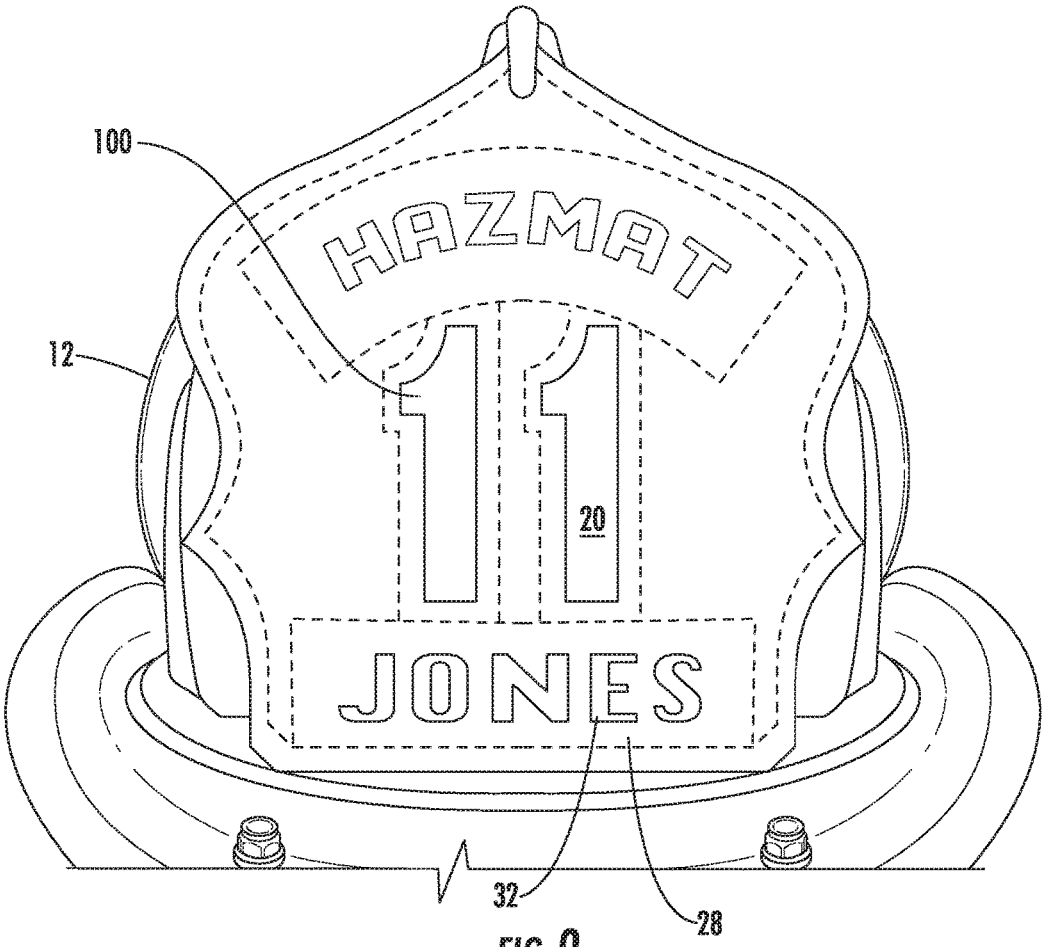
FIG. 9 is a front view illustrating the photoluminescent identifier system secured to a firefighter's helmet, shown secured under leather with cutouts.
Figure 10:
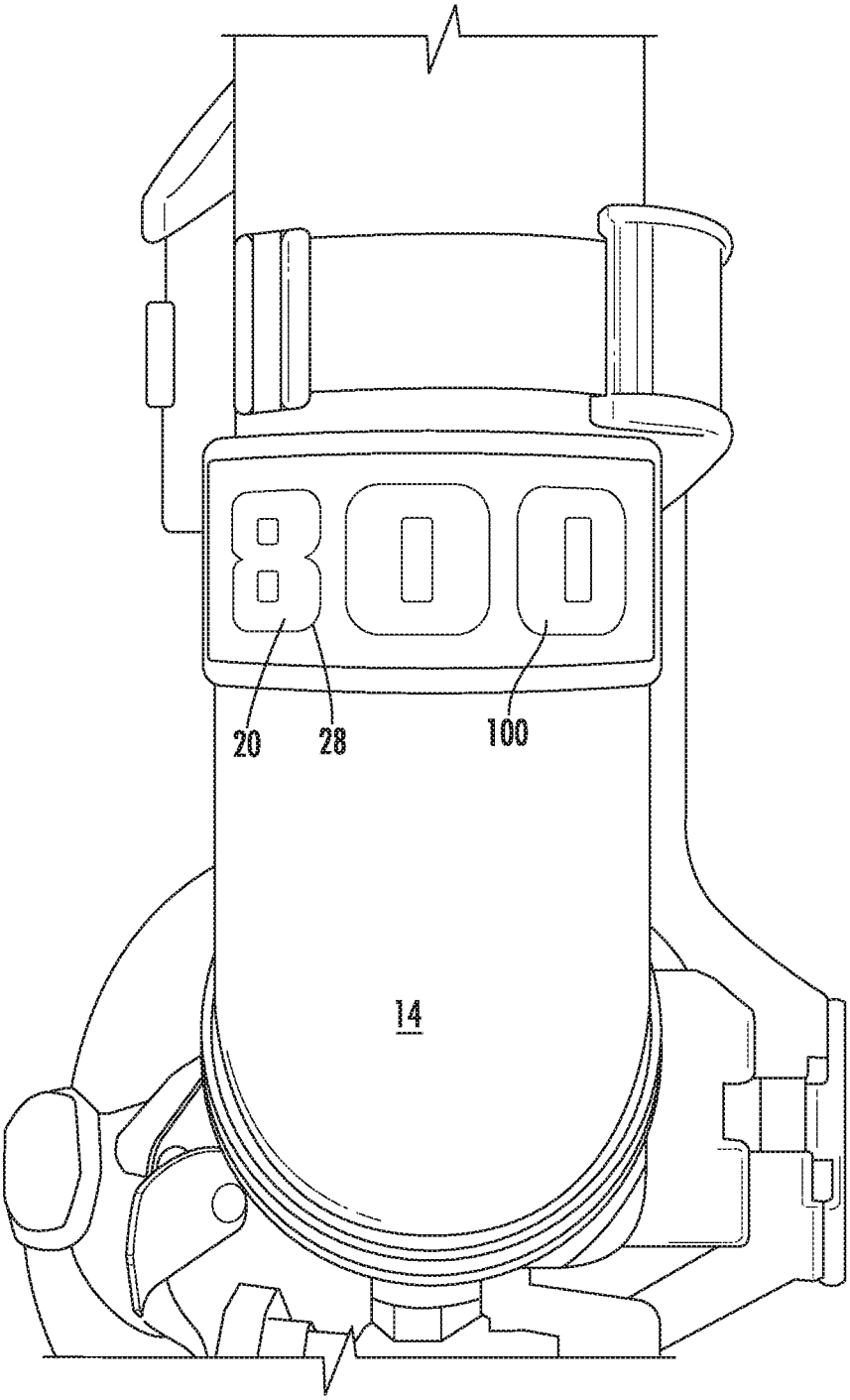
FIG. 10 is a front view illustrating the photoluminescent identifier system secured to a firefighter's tank, shown secured to a leather strap.

Referring now to FIGS. 1-10, a lightweight fire-resistant photoluminescent identifier system 100 for firefighters is illustrated. The photoluminescent identifier system 100 is suitable for use on the firefighter's facemask 10, helmet 12, or tank 14 as well as other equipment. The photoluminescent identifier system 100 is lightweight and provides individual recognition of an individual firefighter. The photoluminescent identifier system 100 is constructed and arranged to light up automatically in a low-light environment through photoluminescent technology without batteries; yet, the photoluminescent identifier system 100 is constructed to prevent glare or eye adjustment to low light to the firefighter using the system. The components that construct the photoluminescent identifier system 100 are fire-resistant to temperatures up to and exceeding 500 degrees Fahrenheit. In a preferred embodiment, the photoluminescent layer 20 is constructed by 3M. The photoluminescent identifier system 100 is constructed from various layers that provide properties not typically found in photoluminescent devices. The base layer 16 includes a black or dark back face 18 to prevent light from being directed into the facemask from the photoluminescent layer 20. The back face 18 of the base layer 16 also includes a pressure sensitive and heat resistant adhesive layer 22 for attaching the base layer to the facemask 10 or other piece of equipment. The front surface 24 of the base layer 16 is constructed to be reflective silver. In this manner, photons from the photoluminescent layer 20 are reflected back out the front of the photoluminescent strip to create a brighter indicator. The photoluminescent layer 20 is secured to the front surface 24 of the base layer 16 with a heat sensitive adhesive 26 positioned on the back surface 25 of the photoluminescent layer 20, whereby heat is utilized to bond the photoluminescent layer 20 to the base layer 16 to prevent separation in extreme heat, and allow the layered photoluminescent identifier strip 100 to be utilized as a single assembly for attachment and use. A top layer 28 is secured over the photoluminescent layer 20, also with a heat sensitive adhesive 26 positioned on the rear face 30 of the top layer 28. The top layer 28 is cut through in a desired pattern to create indicia 32 when adhered over the photoluminescent layer 20, which allows the photoluminescent layer 20 to be viewed in the sandwiched construction. In a most desirable embodiment, the color of the top layer 28 is chosen to provide a color contrast with respect to the photoluminescent layer 20. In this manner, the firefighter's name or other identifier is visible in both the light and in the dark, while the other desirable properties of the system are also provided. The photoluminescent identifier system 100 may be assembled with the base layer 16, photoluminescent layer 20 and top layer 28 in place prior to shipment, whereby the user merely needs to peel away a backing layer (not shown) for attachment with the pressure sensitive and heat resistant adhesive 22 in a desired position on the firefighter's equipment.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that, while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A photoluminescent identifier system for firefighting equipment comprising:

a base layer, said base layer including a back face and a front face, said base layer back face having a dark color and including a pressure sensitive and heat resistant adhesive layer for attaching said base layer back face to a piece of firefighting equipment, said front face of said base layer is light reflective;

a photoluminescent layer secured to said front face of said base layer with a heat sensitive adhesive on a back surface of said photoluminescent layer, whereby heat is utilized to bond said photoluminescent layer to said base layer;

whereby said photoluminescent layer glows in the dark after being exposed to light to provide an identifier for firefighting equipment.

2. The photoluminescent identifier system of claim 1 including a top layer secured over said photoluminescent layer with a heat sensitive adhesive positioned on a rear face of said top layer, said top layer including a desired pattern cut through said top layer to create indicia when adhered over said photoluminescent layer, which allows said photoluminescent layer to be viewed in the sandwiched construction.

3. The photoluminescent identifier system of claim 2 wherein the color of said top layer is chosen to provide a color contrast with respect to said photoluminescent layer, whereby said identifier is visible in both the light and in the dark.

4. The photoluminescent identifier system of claim 2 wherein said photoluminescent identifier system is pre-assembled utilizing heat so that said photoluminescent identifier system is attached to said firefighting equipment as a single assembly utilizing pressure sensitive adhesive.

5. The photoluminescent identifier system of claim 2 wherein said front surface of said base layer is constructed to be reflective silver to reflect photons from said photoluminescent layer back out a front surface of said photoluminescent layer.

6. The photoluminescent identifier system of claim 1 wherein said firefighting equipment is a facemask, and wherein said photoluminescent identifier system is secured to a front surface of said facemask.

7. The photoluminescent identifier system of claim 6 wherein said dark back face of said base layer is constructed and arranged to prevent light from being directed rearward from said photoluminescent layer.

8. The photoluminescent identifier system of claim 7 wherein said dark back face is black in color.

9. The photoluminescent identifier system of claim 2 wherein said photoluminescent identifier system is constructed and arranged to light up automatically in a low-light environment through photoluminescence technology.

10. The photoluminescent identifier system of claim 2 wherein said photoluminescent identifier system provides recognition of an individual firefighter.

11. The photoluminescent identifier system of claim 2 wherein said components of said photoluminescent identifier system are fire-resistant to temperatures up to 500 degrees Fahrenheit.

12. The photoluminescent identifier system of claim 4 wherein said photoluminescent identifier system is secured to a firefighter's helmet.

13. The photoluminescent identifier system of claim 4 wherein said photoluminescent identifier system is secured to a firefighter's air tank.

14. A photoluminescent identifier system for firefighting equipment comprising:

a layered assembly, whereby said layers are assembled with heat sensitive adhesive including a base layer, said base layer including a back face and a front face, said base layer back face having a dark color and including a pressure sensitive and heat resistant adhesive layer for attaching said base layer back face to a piece of firefighting equipment, said front face of said base layer being light reflective, a photoluminescent layer secured to said front face of said base layer with a heat sensitive adhesive on a back surface of said photoluminescent layer, whereby heat is utilized to bond said photoluminescent layer to said base layer, a top layer secured over said photoluminescent layer with a heat sensitive adhesive positioned on a rear face of said top layer, said top layer including a desired pattern cut through said top layer to create indicia when adhered over said photoluminescent layer, which allows said photoluminescent layer to be viewed in the sandwiched construction, whereby said photoluminescent layer glows in the dark after being exposed to light to provide an identifier for firefighting equipment.

15. The photoluminescent identifier system of claim 14 wherein said dark back face of said base layer is constructed and arranged to prevent light from being directed rearward from said photoluminescent layer.

16. The photoluminescent identifier system of claim 15 wherein said dark back face is black in color.

17. The photoluminescent identifier system of claim 14 wherein said components of said photoluminescent identifier system are fire-resistant to temperatures up to 500 degrees Fahrenheit.

* * * * *